US005893612A

United States Patent [19]

Boucherie

[11] Patent Number: 5,893,612

[45] Date of Patent: Apr. 13, 1999

[54] APPARATUS AND METHOD FOR ROUNDING FIBER ENDS OF BRUSHES

[75] Inventor: Bart Gerard Boucherie, Izegem, Belgium

[73] Assignee: Firma G.B. Boucherie, Naamloze Vennootschap, Izegem, Belgium

[21] Appl. No.: 08/766,776

[22] Filed: Dec. 13, 1996

[30] Foreign Application Priority Data

| | | | |
|---|---|---|---|
| Dec. 13, 1995 | [BE] | Belgium | 09501032 |
| Feb. 9, 1996 | [EP] | European Pat. Off. | 96200288 |
| Aug. 14, 1996 | [DE] | Germany | 296 14 118 U |

[51] Int. Cl.[6] ..... A46D 1/04

[52] U.S. Cl. ..... 300/2; 300/10; 300/18; 300/21

[58] Field of Search ..... 300/2, 17, 18, 300/21, 10, 11

[56] References Cited

U.S. PATENT DOCUMENTS

| | | | |
|---|---|---|---|
| 2,426,328 | 8/1947 | Wandel et al. | |
| 2,554,777 | 5/1951 | Dangin . | |
| 2,587,792 | 3/1952 | Von Sivers . | |
| 3,451,173 | 6/1969 | Hazelton | 300/17 |
| 4,144,675 | 3/1979 | Takahashi et al. | 300/17 X |
| 5,165,760 | 11/1992 | Gueret | 300/21 |
| 5,165,761 | 11/1992 | Dirksing | 300/21 |
| 5,176,427 | 1/1993 | Weihrauch | 300/10 |
| 5,431,484 | 7/1995 | Zahoransky et al. | 300/2 |
| 5,472,263 | 12/1995 | Gerspacher | 300/17 |
| 5,593,213 | 1/1997 | Meessmann | 300/21 |
| 5,653,628 | 8/1997 | Weihrauch | 300/17 X |

FOREIGN PATENT DOCUMENTS

1007111A3 4/1995 Belgium .

*Primary Examiner*—John M. Husar
*Attorney, Agent, or Firm*—Bacon &Thomas, PLLC

[57] ABSTRACT

Apparatus for rounding the ends of brush fibers made of thermoplastic material includes a system for moving a smooth treatment surface relative to brush fiber ends at a relative speed and for a selected time to cause the brush fiber ends to be heated to their plastic deformation temperature to cause the brush fiber ends to become rounded. The treatment surface includes at least a portion which has substantially no abrasion, grinding or impacting properties relative to the brush fibers but only substantially friction heating properties relative to the fibers. A method for rounding brush fiber ends is described using the described apparatus.

24 Claims, 2 Drawing Sheets

APPARATUS AND METHOD FOR ROUNDING FIBER ENDS OF BRUSHES

BACKGROUND

1. Field of the Invention

The present invention concerns an apparatus and method for rounding fibre ends of brushes, whose fibres are made of thermoplastic material, more particularly tooth brushes, with a treatment surface, which is moved relatively and transversely in relation to the fibre ends, with which the fibre ends are in contact.

2. Related Technology

During the manufacturing of brushes, after the brush fibres have been inserted or formed in the brush body, the fibres are cut at their free ends in such way that they are situated in one and the same plane. Subsequently, the cut fibre ends must be rounded to remove burrs and sharp edges. Considerable efforts are applied to the quality of the rounding of the fibres of tooth brushes as well as hair brushes, which come in contact with sensitive skin.

Consequently, known brush manufacturing machines comprise several rounding steps through which the brushes successively pass, and in which the fibre ends are put in contact with grinding tools which operate from different directions in order to exert a friction on the brush fibres in all directions. With a view to obtain a particularly high quality of the rounding, which is desired for tooth brush, the fibre ends are subsequently polished. Such final treatment of the brushes can require five to ten treatment steps which therefore constitute an essential part in the total cost of the brush manufacturing. Moreover, a lot of dust is produced which is a problem factor in the final treatment of the brushes.

The rounding is problematic with the fibre ends of those brushes of which the fibres are provided with a profiled cut as a result of which the fibre ends are not situated in one and the same plane. The short fibres are difficult to be reached by the grinding elements. In order to treat them too, the long fibres must previously be kept away by retainers or such like. Devices, with which profiled tooth brushes can be treated are for example described in DE 4 425 231 A1 or DE 4 138 777. These devices are particularly expensive.

This invention aims at a device for rounding fibre ends of brushes and which guarantees at a low cost a particularly good quality with less grinding dust.

BRIEF SUMMARY OF THE INVENTION

According to the invention, the treatment surface and the fibres are positioned with respect to each other in such a way that the fibre ends are shaped in the desired rounded form, essentially by frictional heating. Contrary to all known devices for rounding fibres, the device according to this invention to treat the material is not based on an abrasive but on a frictional effect. The friction surface, as opposed to the surface of a grinding disc, is smooth and contains at the most very fine grinding particles, such as used with polishing discs or belts. The fibre ends are heated up by the friction and reach a softened state. Surprisingly, the thus treated brush fibres are not deformed or damaged but take an almost perfect rounded shape. The nature of the friction surface is not critical. The combination of the most diverse materials offers good results. The relative speed between the fibre ends and the treatment surface has to be comparatively high in order to obtain the friction required for the effect. The speed is considerably higher then the one used with the known grinding devices. Also of interest is to thermically uncouple the treatment surface from its support so as to avoid that the heat locally created by the contact with the fibre ends is transmitted to the support of the treatment surface. However, for such a thermical uncoupling, it suffices to apply to a disc, a drum or similar, which can be made of metal, a layer with a low heat conductivity and a low heat capacity, for example a layer made of synthetic material.

A considerably high quality of rounding is obtained when the following parameters are adjusted one to another:

- the quality of the treatment surface,
- the relative speed between the treatment surface and the fibre ends,
- the material and the quality of the fibres,
- the duration of the contact between the fibre ends and the treatment surface, and finally
- the intensity of this contact of the fibre ends with the treatment surface.

It is a condition, however, that the parameters are not critical at all but can vary within a rather broad range. It is only necessary to ensure that sufficient but not too much frictional heat is produced.

In the preferred embodiment of the device the brushes follow several successive steps in which the intensity and/or the duration of the contact between the treatment surface and the fibre ends decrease step by step.

In the device according to this invention, the treatment tools are essentially of the same shape as the ones used in known devices, and mainly differ by the nature of the treatment surface as well as by the relative speed relative to the fibre ends. It is therefore possible to revert to known constructions, for example rotating treatment drums which, in conjunction with the rotation around their axis, effect rotation or circulation with regard to an axis perpendicular to the axis of rotation, or tumbling discs.

The treatment surfaces undergo a certain wear so that they must be recoated from time to time. It has been noticed that a new coating only offers maximum quality after that the friction element has been covered with a thin layer of the fibre material. The exact relation could not be examined, but it has been experienced that good results are obtained when both friction partners are of a similar if not an identical nature. If the device is provided with several steps whereby the intensity of the contact between the treatment surface and the fibre ends steadily decreases step by step, it is advised to replace the used treatment surface from the first step with the one of the last step, because the latter has adopted after a certain period of use a layer of the material of the fibres.

BRIEF DESCRIPTION OF THE DRAWINGS

Further characteristics and advantages of this invention will appear from the following description and from the accompanying drawings. In the drawings.

Figure 1:
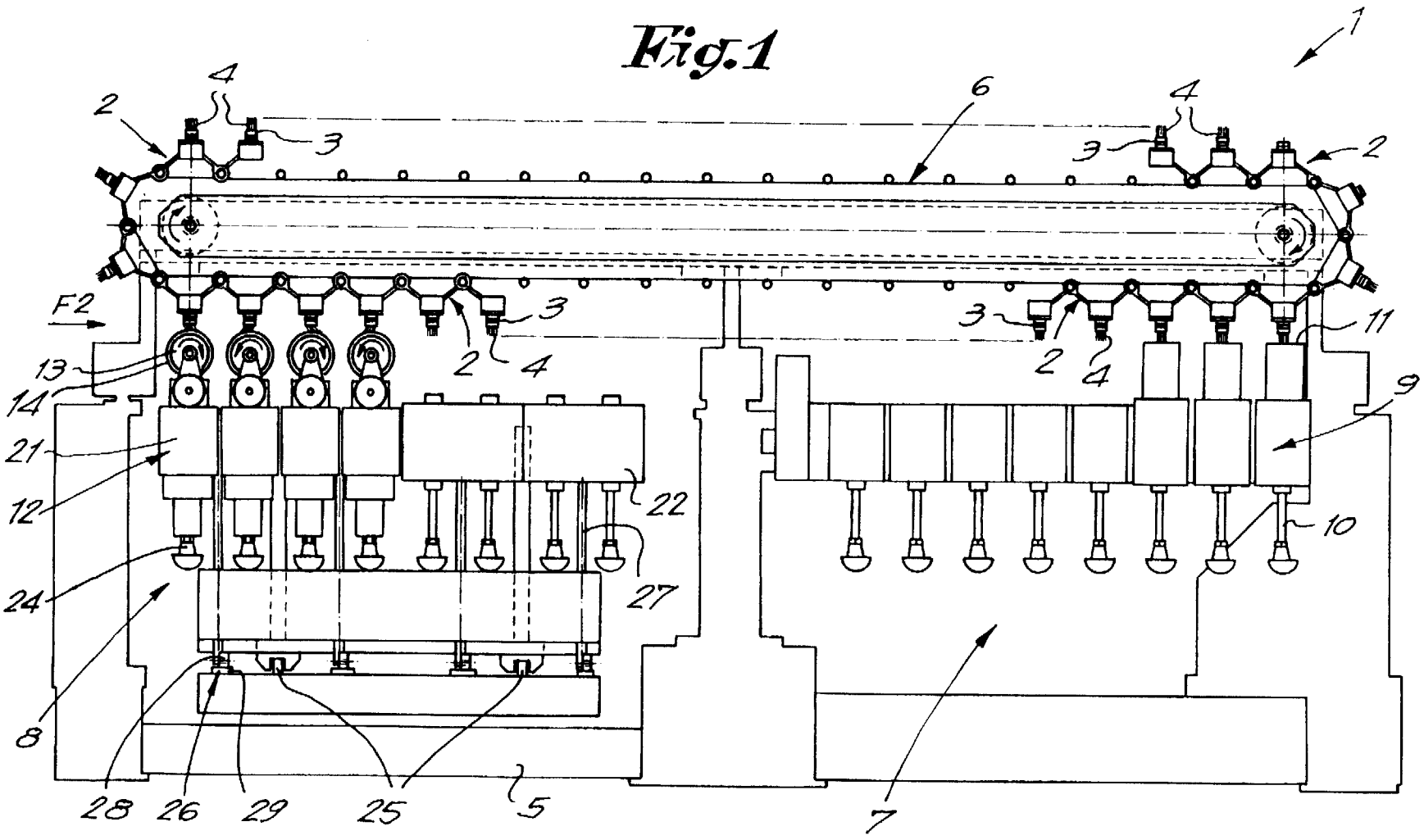
FIG. 1 represents a schematical side-view of a machine for manufacturing brushes with several devices for rounding fibre ends, shown as successive steps.
Figure 2:
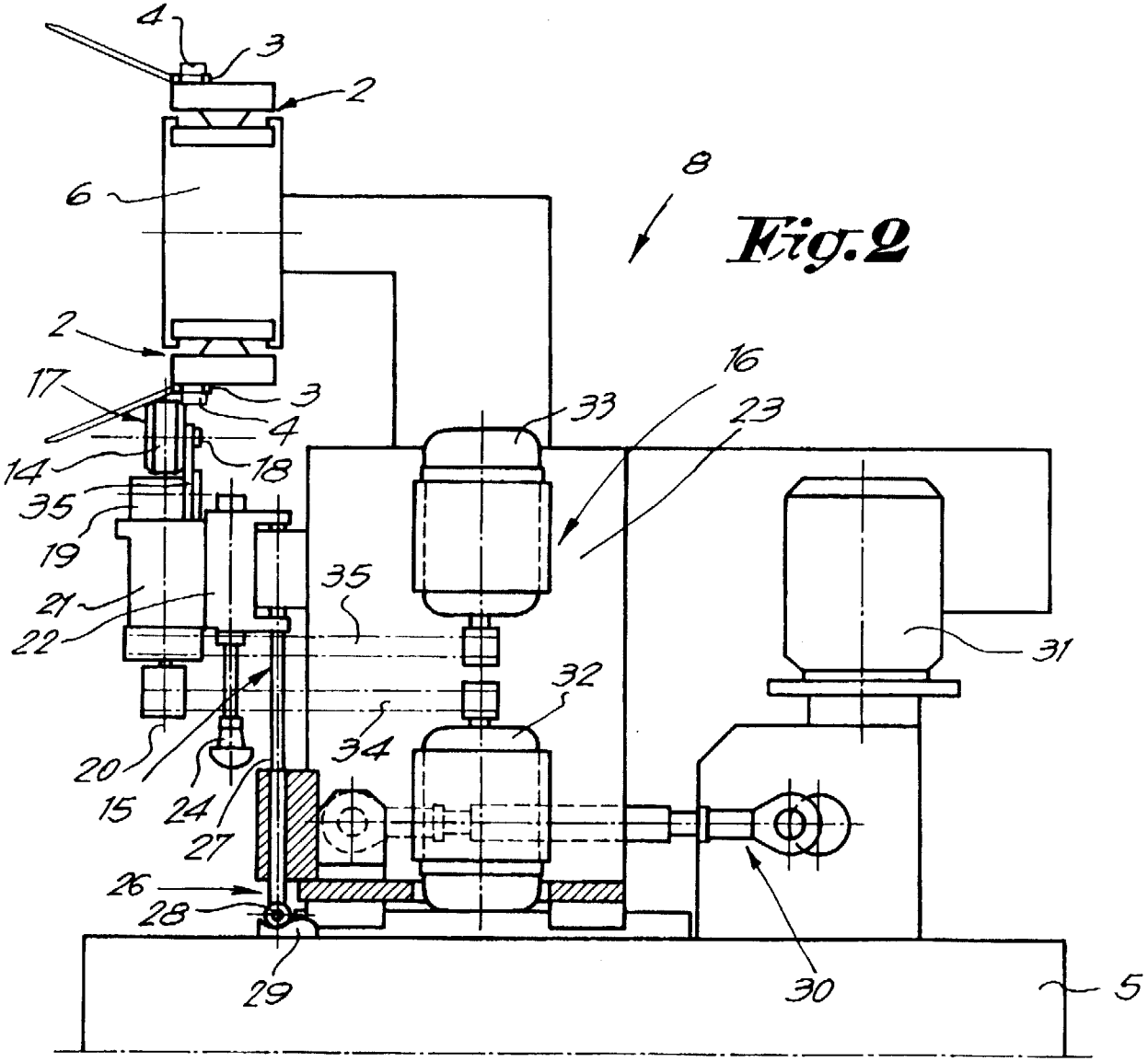
FIG. 2 represents one of the devices in detail.

For rounding the ends of cut fibres made of thermoplastic material, more particularly synthetic thermoplastic material, such as for tooth brushes and hair brushes, the fibre ends are heated by friction in one or more steps, by using a relative movement between the treatment surface and the fibre ends. This relative movement is carried out at high speed as compared to an abrasive treatment, being so adjusted that the material of the fibre ends is softened. Depending on the nature of the material of the fibres, the softening of the material can be obtained almost at its melting point. It is to be noted that beneath a determined relative speed, which can differ according to the material, no rounding effect can be seen, not even when the ends of the brush fibres remain in contact with the treatment surface during a longer period of time. Only by exceeding a determined limit speed, which is to be found by experience, the desired effect of rounding is obtained. It is thought that this effect is based on a plastic deformation of the fibre material. When the relative speed is chosen too high, mushroom-shaped thickenings can occur at the fibre ends or the fibres can melt into each other. The high limit value of the relative speed has to be found by experience as well.

DETAILED DESCRIPTION

The treatment surface can—but need not—also have abrasive properties, for example by grinding particles embedded therein, however the latter may not have an average size greater than almost 40 μm, so as to assure that the friction effect has a preponderance over the abrasive effect. With such size of grinding particles one speaks of polishing substances.

In preferred embodiments the relative movement between the treatment surface and the fibre ends has an evenly changing direction, for example in a treatment device as described in Belgian Patent Application No 94 00 745 of Aug. 17, 1994. Alternatively all the points of the treatment surface simultaneously follow the same circular courses, such as described in the Belgian Patent Application No. 95 00 402 of May 4, 1995.

When the fibre ends are sufficiently heated by the friction on the treatment surface, here predominantly by a friction effect, they are rounded in a surprisingly perfect way with a microscopically smooth surface. Almost all fibre ends of a brush obtain such rounding; even with profiled brushes, whose fibres have different lengths, for example with a wave profile, the fibres have more than 95% of the fibre ends perfectly rounded.

Essentially, the relative speed between the fibre ends and the treatment surface can be caused by the movement of the brushes or by the movement of the treatment device, or by both; preferably embodiments are chosen in which the brushes are stationary and the treatment device, to which the treatment surface is fixed, is moved.

The treatment device, which contains the treatment surface provided with good friction properties, can be a rotating disc which can additionally effect a tumbling movement, a rotating drum, which additionally rotate or circle around an axis perpendicular to the axis of rotation, a pivoting disc or an endless belt, as for example described in Belgian Patent No. 1 007 111. In the case of a rotating drum, the drum surface can be cylindrically shaped, curved, profiled or ribbed.

The fibres can extend in any direction during the treatment. The fibre ends can be directed vertically with their ends up, with their ends down or with their ends sidewards.

To realize the desired rounding effect, the nature of the treatment surface is of importance. It has to exert sufficient friction with respect to the material of the fibres so that the fibre ends are heated by friction when the relative speed between the treatment surface and the fibre ends is sufficiently high. It is also favourable that the friction contact between the fibre ends and the treatment surface is produced from different directions and at different points.

The nature of the treatment surface is, however, not critical. Good results were obtained with different synthetic materials. For a high constancy of the treatment surface it has been noted that the use of a layer of a material, which is usually applied for polishing, is a good choice. For polishing marble and natural stone, layers are known which are also appropriate for the aim of the present invention. Such product is a material, composed of a textile woven support, impregnated with resin, and provided at one side with burls in which grinding particles are embedded (diamond dust). These grinding particles, however, need to be very fine and with an average size not exceeding 40 μm. This material shows to be very appropriate in relation to the usual thermoplastic material, from which brush fibres are made, because it has the desired friction properties and even a higher constancy, and moreover is sufficiently thermically uncoupled by its layer from its driven support, such that the friction heat produced in the fibre ends is not transmitted to the driven support of the treatment surface.

Systematic tests have shown that a multiplicity of working material is appropriate for the treatment surface. Even known adhesive tapes or adhesive layers, applied to a drum, offer good results. However, taking into account the high constancy, layers are preferred such as the ones applied for polishing.

If a treatment surface is used through which a part of the friction heat of the fibre ends is transmitted to the support of the treatment surface, such heat losses can be compensated by supplying additional heat from outside. For example, the support of the treatment surface is heated. Heat losses at the treatment surface can also be compensated with a sufficiently high relative speed between the treatment surface and the fibre ends.

The treatment surface can be made of a covering of a driven support or also of a solid part.

Preferably, the treatment is carried out in several steps whereby the intensity of contact between the fibre ends and the treatment surface successively decreases step by step. In the first step, the treatment surface intrudes the fibre ends approximately up to half of the length of the fibres. In this step it is possible that burrs are formed at the fibre ends which are smoothed away in the following step, though hereby it is favourable if the treatment surface is provided with steps or burls. It is presumed that these steps or burls favourably effort removal of the burrs of the fibre ends. In the final treatment step, the treatment surface is only moved up to the free ends of the fibres with which it realizes a very small contact.

If the rounding of the fibre ends is carried out in several steps it can be favourable to cool down the brush fibres after each treatment and before the next.

A particular characteristic of the device according to the invention is that less dust is created by the friction of the brush material. The production of dust is practically reduced to these treatment steps whereby the brush fibres are not yet or not sufficiently heated to realize a plastic deformation.

The treatment machine 1, represented in FIG. 1, for the final treatment of tooth brushes is provided with a row of holders 2 for brush bodies 3, in which brush fibres 4 are embedded. Each holder 2 contains in the represented embodiment a brush body 3; in other embodiments each holder can contain two or more brush bodies.

The holders 2 are coupled with an endless conveyor belt 6, fixed to frame 5. Furthermore are fixed to the machine frame 5 a cutting device 7 for cutting the brush fibres 4 as well as a group 8 of rounding units. The cutting device 7, as well as the group 8 of rounding devices is fixed next to the lower run of the conveyor belt 6.

The cutting device 7 for cutting brush fibres 4 contains several cutting units 9 of a known construction. These cutting units 9 are provided with control elements 10 which take care that the cutting plane 11 of each cutting unit can be positioned at the correct height. By means of these control elements 10 the length, at which the brush fibres 4 must be cut, can be adjusted.

Depending on the nature of the knives in the cutting units 9 the brush fibres are cut off flat or with a certain profile. By means of additional devices, for example the ones described in EP 0 078 569 A1, the brush fibres can be cut off at two or more lengths.

The group 8 contains several rounding units 12 which each contain a treatment element 13, of which the treatment surface 14 constitutes a friction surface for the material of the fibre ends. A feeding device 15 brings the treatment surface 14 in contact with the ends of the brush fibres 4. By means of a driving device 16 a relative movement is created between the treatment surface 14 and the fibre ends, in friction contact therewith.

In the embodiment shown, the treatment element 13 consists of a cylindrical drum 17 whose circumferential surface forms the treatment surface 14 and whose axial width practically coincides with the length of the part of a tooth brush which is provided with brush fibres 4.

The drum 17 is rotatably fixed by means of a shaft 18. This shaft 18 is fixed in a support 19 which can rotate in a or housing 21 around a shaft 20. This shaft 20 is parallel to or almost parallel to the direction of the brush fibres 4 and is directed to the center of the treatment surface 14 on the drum 17.

The casing 21 of each rounding unit 12 is fixed to a carriage 23 by means of a connecting element 22 which can be moved in the longitudinal direction of the brush fibres 4. To each connecting element 22 are fixed one or several such casings 21, whereby each casing 21 can be adjusted individually by means of a control element 24 in the height, i.e. in the longitudinal direction of the brush fibres 4. Several similar connecting elements 22 can be coupled one to another.

The carriage 23 is located in a slidable manner on a guide 25 which is fixed on the frame 5, such that the carriage 23 can slide in a direction which is parallel to the longitudinal direction of the part of the brush bodies 3 which is filled with brush fibres 4.

The connecting elements 22 can be moved in the longitudinal direction of the brush fibres 4 in relation to the carriage 23 by means of a cam drive 26 consisting of a cam 29 which is to be fixed to the frame 5, and a shaft 27, which is slidably mounted in the longitudinal direction of the brush fibres 4 to the carriage 23 and which is supported by the cam 29 by means of a a cam follower 28. If a group of coupled connecting elements 22 is provided, as represented in FIG. 1, several cam drives 26 can be provided whose cams 29 have the same active surface.

Between the carriage 23 and the frame 5 a crank mechanism 30 is provided, whose crankshaft is driven by an electric motor 31. This electric motor 31 is fixed to the frame 5.

On the carriage 23 two electric motors 32, 33 are fixed. The output shaft of the electric motor 32 is coupled via a belt 34 to the shaft 20 and the output shaft of the electric motor 33 via a belt 35 with the shaft 18 of the drum 17. The transmissions are preferably made in such a way that the drums 17 of neighbouring rounding units 12 are driven in opposite sense.

By means of the conveyor belt 6, the brush bodies 3, already provided with brush fibres 4, are successively moved towards the cutting units 9, whereby these brush fibres 4 are brought in contact with cutting knives and are cut in several steps. Subsequently, the brush bodies 3 with the cut brush fibres are transported to the rounding units 12, whereby the fibre ends are rounded in several steps.

In each rounding unit 12 the drum 17, with its treatment surface 14, rotates around its shaft 18, on the one hand, and rotates in a perpendicular direction around the shaft 20, on the other hand. The combination of both above-mentioned rotary movements will ensure that the fibre ends are put in frictional contact with the treatment surface 14 which operates from different directions. Thanks to this frictional contact the brush fibres will be heated as previously described and put in a situtation such that the brush fibres are plastically deformed and therefore rounded. Each drum 17 with the treatment surface 14 is also moved in the longitudinal direction of the part of the brush body 3 which is filled with brush fibres thanks to the to-and-fro movement of the carriage 23 which is caused via the crank mechanism 30 by the electric motor 31.

The to-and-fro movement of the carriage 23 causes the movement of the cam follower 28 over the cam 29, such that the connecting element 22 and consequently also the drum 17 creates with its treatment surface 14 an alternating lifting movement directed against the ends of the brush fibres 4. By means of this alternating lifting movement several long brush fibres 4 are alternately treated in one treatment step. Contrary to the known rounding devices, the short brush fibres of the profile-shaped brushes need not be treated separately nor the longer brush fibres previously retained or withdrawn.

In the case of non profiled brushes, whose fibre ends are situated in one and the same plane, or of profiled brushes provided with a small profile depth, the crank mechanism and the cam drive 26 can be omitted.

The rotational speed of the electric motors 31, 32 and 32, is always controlled separately, for example by means of a frequency regulator.

The nature of the friction surface 14 and the relative speed of its movement with regard to the fibre ends is of utmost importance for the rounding effect. The required relative speed lies between 10 to 30 m/sec, preferably 16 and 22 m/sec, and is therefore essentially higher than the one used with the grinding operations.

It is presumed that only on account of such high relative speed the fibre ends can be heated enough and take their rounded form by means of a plastic deformation. The treatment surface 14 needs to be able to cause friction with regard to the material of the brush fibres. It can additionally have abrasive properties, but with a high degree of fineness, as required for polishing purposes. When grinding particles are embedded in the treatment surface they may not exceed an average size of 40 μm. Preferably a usual layer is applied on the circumference of the drum 17 such as used for polishing marble and natural stone. These polishing layers contain on their surface a large number of burls in which fine grinding particles are embedded. Polishing layers containing grinding particles with an average size of only 10 μm are particularly appropriate. Such a layer possesses the desired frictional balance with regard to the usual thermoplastic materials which are used for the manufacture of brush fibres.

It also possesses the required thermoplastic properties because it does not transmit the heat created by the friction with fibre ends to the drum 17. The lesser abrasive effect contributes to a microscopically smooth surface of the perfectly rounded fibre ends.

The structure of the friction surface 14 is, however, not critical as long as it shows the required frictional properties and is driven with the required relative speed with respect to the fibre ends.

The treatment of the fibre ends takes place in several rounding units 12 with decreasing intensity, such that after the final treatment step the rounded fibre ends show a microscopically smooth surface.

The application of this invention does not imply that the brush fibres must be cut off flat. They can also be pre-treated, for example in a preceding step in which they are ground in the usual manner. On the other hand, such pre-treatment is not a condition for the favourable functioning of the device according to the invention.

I claim:

1. An apparatus for rounding the ends of brush fibers made of thermoplastic material, comprising:

a brush holder arranged to present the fiber ends of a brush retained in said holder to a treatment surface;

a treatment surface adjacent said brush holder and arranged to move relative to and into contact with the fiber ends of a brush retained in said holder;

a supporting and moving mechanism arranged to move the treatment surface at a selected speed for a selected time relative to said brush fiber ends in directions extending transversely of the fibers sufficient to heat said brush fiber ends to their plastic deformation temperature;

said treatment surface having at least a portion which is smooth, said portion having substantially no abrasion, grinding or impacting properties relative to the brush fibers but substantially only friction heating properties relative to said brush fibers;

said treatment surface being connected to a support so as to be thermally uncoupled from the support; and whereby said brush fiber ends, upon frictional contact with the moving treatment surface for said selected time at said selected relative speed are rounded by temporary heating of same into a state of plastic deformation.

2. The apparatus according to claim 1, wherein said portion of said treatment surface has no abrasion, grinding or impacting properties at all relative to said brush fibers.

3. The apparatus according to claim 1, wherein said entire treatment surface has substantially no abrasion, grinding or impacting properties relative to said brush fibers.

4. The apparatus according to claim 1, wherein said supporting and moving mechanism includes a device for bringing said treatment surface and said brush fiber ends into contact with each other in ever changing relative directions.

5. The apparatus according to claim 4, wherein said treatment surface comprises a peripheral surface of a drum rotatable about a drum axis and said supporting and moving mechanism includes a device that rotates the drum about the drum axis.

6. The apparatus according to claim 5, wherein said drum is mounted for rotation or circular motion around an axis which is perpendicular to said drum axis and said supporting and moving mechanism includes a device that rotates the drum about said axis that is perpendicular to said drum axis.

7. The apparatus according to claim 4, wherein said treatment surface comprises a surface of a disc mounted for rotation about a disc axis and said supporting and moving mechanism includes a device that rotates the disc about the disc axis.

8. The apparatus according to claim 7, wherein said mounting and moving mechanism is arranged to cause the disc to tumble during its rotation.

9. The apparatus according to claim 1, wherein said treatment surface contains a layer made of a material which is similar to the material of said brush fibers.

10. The apparatus according to claim 9, wherein said treatment surface contains a layer made of a material which is identical to the material of said brush fibers.

11. The apparatus according to claim 1, wherein said treatment surface contains embedded fine polishing particles of an average size no greater than 40 μm.

12. The apparatus according to claim 1, wherein said supporting and moving mechanism is arranged to move said treatment surface relative to said brush fibers at a speed of between 10 and 30 m/sec.

13. The apparatus according to claim 12, wherein said treatment surface has brush fiber polishing properties.

14. The apparatus according to claim 13, wherein said treatment surface includes burls.

15. The apparatus according to claim 1, wherein said treatment surface is connected to said support by a layer of plastic material.

16. A method for rounding the ends of brush fibers made of thermoplastic materials, comprising the steps of:

providing a treatment surface having a smooth portion having substantially no abrasion, grinding or impacting properties relative to the brush fibers but substantially only friction heating properties relative to the brush fiber ends;

placing the treatment surface in contact with the brush fiber ends and moving the treatment surface relative to the fiber ends at a selected relative speed for a selected time to cause the ends of the brush fibers to undergo temporary heating and plastic deformation into rounded ends; and keeping the treatment surface thermally uncoupled from a support for the treatment surface.

17. The method according to claim 16, including carrying out the contacting of the brush fiber ends with the treatment surface over a successive number of treatment steps, including decreasing the intensity of contact between the treatment surface and the brush fiber ends from step to step.

18. The method according to claim 17, wherein the step of contacting the brush fiber ends with the treatment surface over a successive number of steps includes:

decreasing the duration of time of contact between the treatment surface and the brush fiber ends from step to step.

19. The method according to claim 17, including providing a number of burls on the treatment surface.

20. The method according to claim 16, wherein during the contact between the treatment surface and the brush fiber ends, the treatment surface is moved relative to the brush fiber ends in ever changing directions.

21. The method according to claim 16, further comprising the step of:

varying the degree of plastic deformation caused to the brush fiber ends by varying at least one parameter selected from the group consisting of the friction properties of the treatment surface, the relative speed between the treatment surface and the brush fiber ends, the material and frictional properties of the brush fibers, the time of contact between the brush fiber ends and the treatment surface, and the intensity of the contact between the brush fiber ends and the treatment surface.

22. The method according to claim 16, including providing the treatment surface with embedded fine polishing particles having an average size of no greater than 40 μm to enhance the friction effect.

23. The method according to claim 16, wherein, during the step of contacting the treatment surface with the brush fiber ends, the treatment surface is moved relative to the brush fiber ends at a speed of between 10 and 30 m/sec.

24. An apparatus for rounding the ends of brush fibers made of thermoplastic material, comprising:

a brush holder arranged to present the fiber ends of a brush retained in said holder to a treatment surface;

a treatment surface adjacent said brush holder and arranged to move relative to and in contact with the fiber ends of a brush retained in said holder, said entire treatment surface having substantially no abrasion, grinding or impacting properties relative to said brush fibers; and a supporting and moving mechanism arranged to move the treatment surface at a selected speed for a selected time relative to said brush fiber ends in directions extending transversely of the fibers sufficient to heat said brush fiber ends to their plastic deformation temperature;

whereby said brush fiber ends, upon frictional contact with the moving treatment surface for said selected time at said selected relative speed are rounded by temporary heating of same into a state of plastic deformation.

* * * * *